US012790727B1

(12) United States Patent
Bennett et al.

(10) Patent No.: US 12,790,727 B1
(45) Date of Patent: Nov. 10, 2026

(54) ARTICLE OF APPAREL INCLUDING TEXTILE WITH LOWER FIBER SHED

(71) Applicant: Under Armour, Inc., Baltimore, MD (US)

(72) Inventors: Haley Bennett, Baltimore, MD (US); Courtney Rothermel, Baltimore, MD (US); Kyle Blakely, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 19/440,099

(22) Filed: Jan. 5, 2026

Related U.S. Application Data

(60) Provisional application No. 63/742,186, filed on Jan. 6, 2025.

(51) Int. Cl.
*D04B 1/02* (2006.01)
*D04B 1/24* (2006.01)
*D04B 21/20* (2006.01)

(52) U.S. Cl.
CPC ..... *D04B 1/02* (2013.01); *D04B 1/24* (2013.01); *D04B 21/207* (2013.01); *D10B 2201/02* (2013.01); *D10B 2403/0114* (2013.01)

(58) Field of Classification Search
CPC . D04B 1/02; D04B 1/025; D04B 1/04; D04B 1/26; D04B 1/123; D04B 7/12; D04B 7/24; D04B 9/12; D04B 9/14; D04B 9/26; D04B 21/02; D04B 21/04; D04B 23/08; D04B 23/10
USPC ..... 66/191, 194
See application file for complete search history.

(56) References Cited

U.S. PATENT DOCUMENTS 2,893,226 A * 7/1959 Lombardi ..... D04B 9/26 66/93
3,977,216 A * 8/1976 Lombardi ..... D04B 15/06 66/107
4,038,838 A * 8/1977 Lombardi ..... D04B 9/12 66/107

(Continued)

FOREIGN PATENT DOCUMENTS

CN 111719223 A * 9/2020 ..... D04B 1/02
EP 1529864 A1 * 5/2005 ..... D04B 21/02

*Primary Examiner* — Danny Worrell
(74) *Attorney, Agent, or Firm* — Edell, Shapiro & Finnan, LLC

(57) ABSTRACT

A fleece textile includes a face layer formed or constructed of first filaments or yarns, the face layer defining a face side including first loops of the first yarns extending from the face side, and the first filaments or yarns including one or more non-synthetic materials and/or highly biodegradable materials, a backside layer formed or constructed of second filaments, the backside layer defining a fleece side including second loops of the second filaments extending from the fleece side, and the second filaments including one or more synthetic materials, and an intermediate layer formed or constructed of third filaments, the intermediate layer being disposed between the face side and the fleece side with the third filaments coupling with each of the first filaments or yarns and the second filaments, and the third filaments including one or more synthetic materials. The second loops have greater lengths than the first loops.

20 Claims, 3 Drawing Sheets

(56) References Cited

U.S. PATENT DOCUMENTS

| | | | | | |
|---|---|---|---|---|---|
| 4,103,518 | A * | 8/1978 | Lombardi | D04B 15/06 | 66/107 |
| 4,712,281 | A * | 12/1987 | Scheller | D04B 21/02 | 28/162 |
| 5,508,098 | A * | 4/1996 | Omar | B32B 5/026 | 442/319 |
| 5,855,125 | A * | 1/1999 | Lohmueller | D06C 11/00 | 28/162 |
| 5,896,758 | A * | 4/1999 | Rock | A43B 23/0205 | 66/194 |
| 7,579,045 | B2 * | 8/2009 | Rock | D04B 1/24 | 427/261 |
| 7,926,307 | B1 * | 4/2011 | Williams | D04B 1/02 | 66/194 |
| 11,008,681 | B2 * | 5/2021 | Lawrence | D04B 21/04 | |
| 11,712,077 | B2 * | 8/2023 | Moretti Polegato | A41D 27/28 | 428/90 |
| 2018/0338563 | A1 * | 11/2018 | Moretti Polegato | A41D 27/28 | |
| 2023/0212795 | A1 * | 7/2023 | Hicks | A43B 23/027 | 36/45 |
| 2025/0092586 | A1 * | 3/2025 | Dandapure | D04B 1/16 | |

* cited by examiner

ARTICLE OF APPAREL INCLUDING TEXTILE WITH LOWER FIBER SHED

CROSS REFERENCE TO RELATED APPLICATION

This application claims priority from U.S. Provisional Patent Application No. 63/742,186, filed Jan. 6, 2025, the entire disclosure of which is incorporated herein by reference.

FIELD OF THE INVENTION

The present invention relates to textiles that form articles of apparel and, in particular, to fleece textile.

BACKGROUND OF THE INVENTION

Apparel manufacturers are increasingly concerned with fiber shedding, in which fibers and/or fiber fragments are released from the textile fabric. For example, during the washing cycle of a garment including a textile formed of synthetic fibers, the fibers or fragments of the fibers may be released into solution, being discharged with the greywater. This is a particular concern with fleece textiles, which is characterized by a dense and soft pile structure. During laundering, a typical fleece jacket sheds more than 80,000 synthetic fibers. Approaches to mitigate shedding have generally focused on coatings that applied to fleece during manufacture.

It would be beneficial to provide a fleece textile material that reduces or minimizes fiber shedding while maintaining the same soft, plush and insulating properties of conventional fleece materials.

BRIEF SUMMARY

In an embodiment, a fleece textile comprises a face layer constructed of first yarns, the face layer including an exposed, first surface including first loops of the first yarns extending from the first surface, and the first yarns comprising one or more non-synthetic materials and/or biodegradable materials. The fleece textile further comprises a fleece layer constructed of second yarns, the fleece layer including an exposed, second surface that opposes the first surface and includes second loops of the second yarns extending from the second surface, and the second yarns comprising one or more synthetic materials. An intermediate layer constructed of filaments is disposed between the face layer and the fleece layer with the filaments of the intermediate layer coupling with each of the first yarns and the second yarns, and the filaments of the intermediate layer comprising one or more synthetic materials. The second loops have greater lengths than the first loops.

In another embodiment, a textile comprises a face layer constructed of first yarns, the face layer including an exposed, first surface including first loops of the first yarns extending from the first surface, and the first yarns comprising a non-synthetic and/or biodegradable material. The textile further comprises a backside layer constructed of second yarns, the backside layer including an exposed, second surface that opposes the first surface and includes second loops of the second yarns extending from the second surface, and the second yarns comprising polyester. An intermediate layer constructed of filaments is disposed between the face layer and the backside layer with the filaments of the intermediate layer coupling with each of the first yarns and the second yarns, and the filaments of the intermediate layer comprising polyester. The second loops have greater lengths than the first loops.

In a further embodiment, a method of forming a textile comprises knitting a face layer with first yarns, the face layer defining an exposed, first surface with first loops of the first yarns extending from the first surface, and the first yarns comprising one or more non-synthetic materials and/or biodegradable materials. The method further comprises knitting a backside layer with second yarns, the backside layer defining an exposed, second surface with second loops of the second yarns extending from the second surface, and the second yarns comprising one or more synthetic materials. The method also comprises knitting an intermediate layer with filaments, the intermediate layer being disposed between the face layer and the backside layer with the filaments of the intermediate layer coupling with each of the first yarns and the second yarns so as to form a three layer knit structure, and the filaments of the intermediate layer comprising one or more synthetic materials. The knitting the face layer and backside layer results in the second loops having greater lengths than the first loops.

The textile as described herein exhibits a reduced amount of fiber shedding in comparison to conventional fleece fabrics while providing a suitable look and feel of fleece.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION

Figure 1A:
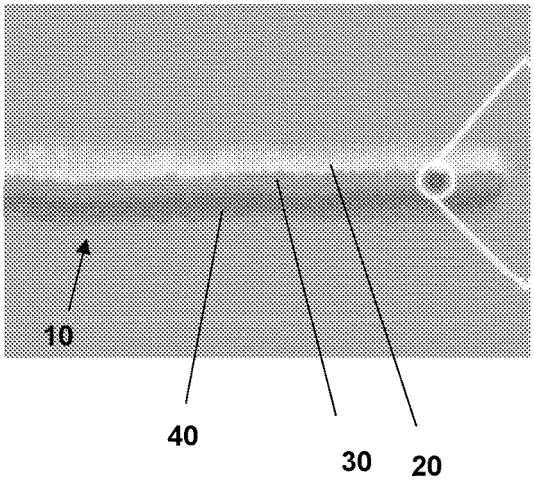
FIG. 1A depicts a cross-sectional view in perspective of an embodiment of a three thread fleece textile formed in accordance with embodiments described herein, in which the loops at the fleece side remain intact (i.e., have not been cut or sheared, i.e., the loops remain continuous).

In the following detailed description, reference is made to the accompanying figures that form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

A typical fleece material is formed or constructed as a three thread textile including a top layer (also referred to as the face layer or face side) and a backside layer (also referred to as the fleece layer or fleece side). The top layer or face side is typically formed of yarns comprising a blend of spun polyester and spun cotton (a spun poly/spun cotton blend). The backside layer or fleece side is formed of yarns comprising Chief Value Cotton (i.e., CVC yarns), where CVC yarns typically include a ratio of cotton to polyester that results in more cotton in the CVC yarns (e.g., a 60:40 or 80:20 cotton to polyester blend). Intermediate yarns or tie yarns are typically formed of yarns comprising polyester filaments (i.e., monofilament yarns of polyester), where the tie yarns are knit together with the yarns of the face layer and backside layer.

The three-thread fleece is formed by knitting the three yarns together such that the yarns on the fleece side include loops that are floated out from the backside/fleece side. These loops can be cut or sheared, leaving portions of the yarns from the backside/fleece side extending outward from the textile.

The shedding of plastic that occurs in fleece textiles (when polyester is used in one or more yarns of the different layers) can be an environmental concern. This is further increased due to the cutting or shearing of the loops in the yarns that define the fleece side, where small or micro portions of plastic (e.g., polyester) can be released into the environment (e.g., in lakes, rivers, oceans and other waterways).

As described herein, a fleece textile construction is provided that minimizes and/or eliminates fiber shedding, particularly when compared to a conventional fleece textile construction with sheared piles. The fleece textile is formed or constructed including three layers, comprising a front or face side (also referred to as a face layer), a back or fleece side (also referred to as a backside layer or fleece layer), and an intermediate layer (also referred to as a tie layer) including filaments that couple the face layer with the backside layer or fleece layer. The backside or fleece side includes loops of continuous filament yarns extending from the textile that are intact (not cut or sheared). The intermediate layer can comprise or be formed of continuous filaments or yarns that comprise continuous filaments. The term "continuous filament", as used herein, refers to a strand or fiber having a long length, which is different from a short cut or staple filament. In other words, continuous filaments are not staple filaments. The face side also contains loops of continuous filament yarns that can remain uncut or not sheared. By not being cut or sheared means that the loops remain intact or are continuous in relation to the surface of the face side or fleece side. In example embodiments, each and every loop at the face side and/or the fleece side is continuous and thus remains intact (not cut or sheared). This results in the fleece textile exhibiting significantly less fiber shed during manufacture as well as use of the textile (e.g., when incorporated within an apparel or other fabric product).

The continuous filament (e.g., monofilament or multi-filament) yarns forming the face side comprise or preferably consist of (i.e., the continuous filament yarns at the face side are formed of) non-synthetic and/or biodegradable filaments, where the non-synthetic and/or biodegradable filaments present little or no environmental impact in the event any shedding of such filaments from the face side occurs (i.e., no generation of micro plastics in environment due to shedding of face side, as may occur in conventional fleece products). The continuous filaments (e.g., monofilament or multi-filament) yarns forming the fleece side comprise or consist of synthetic filaments. Similarly, the continuous filaments or continuous filament (e.g., monofilament or multi-filament) yarns forming the intermediate layer also comprise or consist of synthetic filaments.

The fleece textile as described herein can be incorporated into any type of fabric product in which characteristics of fleece are desired for the product (e.g., high thermal insulation properties, moisture wicking properties, air circulation/breathability, light weight characteristics, durability, comfortable/soft touch and feel characteristics particularly at the face side, etc.). Some non-limiting examples of fabric products that can be formed with the fleece textile described herein include blankets, bedding materials (e.g., pillow covers, comforters, etc.), apparel (e.g., shirts, sweaters, sweatpants, etc.), headwear, etc.

As previously noted, a conventional, three layer or three thread fleece includes three layers and three different types of yarns or filaments forming or constructing each layer, namely a top layer/face side formed of yarns of a spun polyester/cotton blend, an intermediate layer including polyester filaments, and a backside/fleece side formed of CVC yarns. The cutting or shearing of the loop ends in the yarns at the fleece side results in fiber shedding, both from the cutting process as well as throughout the life of the textile when implemented into a fabric product. When utilizing a polymer fiber for the fleece side, this can result in shedding of plastics (e.g., small or micro-sized synthetic fiber portions from the sheared ends of the fleece side), particularly when the fabric product is washed. The end result can be the introduction of undesired polymers or plastics within wastewater streams of laundry wash cycles which may in turn end up on lakes, streams and oceans.

In the embodiments described herein, a fleece textile material includes three layers that differ from a conventional three layer or three thread fleece based upon different materials used to form the fleece product as well as configuration of the one or both of the face layer and fleece layer. In particular, the textile described herein can comprise a knitted or knit textile, in which the three layers of yarns and/or filaments are knit or combined together in the same or similar manner and configuration as a conventional three thread fleece structure. However, the fleece side of the material includes loops that are maintained as loops (i.e., not cut or sheared but instead remain intact). Further, the three different filaments or yarns used to form the fleece textile material differs from conventional three thread fleece materials.

Figure 1B:
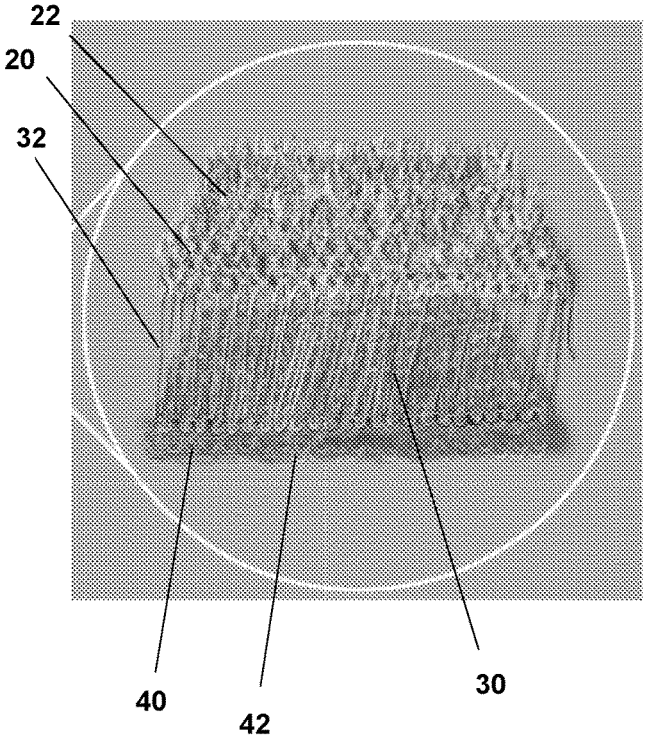
FIG. 1B is an enlarged cross-sectional view of a portion of the textile of FIG. 1A.

An example embodiment of a fleece textile is depicted in FIG. 1A and FIG. 1B, where the fleece textile 10 includes top layer or face layer 20, an intermediate layer or tie layer 30 and backside layer or fleece layer 40. The face layer 20 is formed of continuous monofilament or multi-filament yarns 22, while the tie layer 30 is formed of tie filaments 32 and the fleece side 40 is formed of continuous monofilament or multi-filament yarns 42. The textile 10 is formed as a knit material, with loops of yarns 22, 42 extending from each of the exposed surface or exposed side of the face layer 20 and the exposed surface or exposed side of the fleece layer 40. As shown in FIG. 1A, the exposed side or exposed surface of the fleece layer 40 opposes the exposed side or exposed surface of the face layer 20. As described in further detail herein, due to the configuration of the yarns 42 and length of loops extending from the surface of the fleece layer 40, the fleece layer 40 has a much greater thickness in relation to the thickness for each of the face layer 20 and the intermediate or tie layer 30. While the enlarged view shown in FIG. 1B shows the tie filaments 32 as being elongated, this is shown in exaggeration so as to distinctly and clearly compare and contrast the three different layers forming the textile. When formed, the tie layer 30 is much smaller in thickness dimension in comparison to each of the face layer 20 and fleece layer 40.

The face layer 20 is formed of yarns 22 that comprise or consist of non-synthetic and/or biodegradable filaments. In example embodiments, the filaments of the yarns 22 are formed of non-synthetic and biodegradable materials, where such non-synthetic and biodegradable materials can include, without limitation, cotton, cellulose based materials, etc. In other example embodiments, the yarns 22 forming the face layer 20 can comprise or consist of a synthetic material having suitable biodegradability such that any portion of yarns 22 that sheds from the textile 10 is biodegradable and breaks down in the environment over a short period of time (e.g., much shorter period of time compared to, e.g., portions of polyester of the same or similar size). Some non-limiting examples of synthetic materials that are suitably biodegradable for forming filaments and yarns 22 of the face layer 20 include, without limitation, polylactic acid (PLA), polyhydroxyalkanoates (PHAs), polycaprolactones (PCLs), polybutylene succinate (PBS), polybutylene adipate terephthalate (PBAT), etc. The face layer 20 can also be formed, comprise or consist of a blend of yarns including yarns having or containing non-synthetic and biodegradable filaments and yarns having or containing biodegradable synthetic filaments. In example embodiments, the face layer 20 includes yarns 22 comprising or consisting of cotton filaments (i.e., filaments formed of cotton).

The continuous yarns 42 forming the fleece layer 40 and the filaments 32 forming the tie layer 30 comprise or consist of one or more different types of synthetic filaments. The type of synthetic polymer material used to form the filaments for each of the fleece layer 40 and tie layer 30 can be varied based upon a particular use or application. Some non-limiting examples of synthetic polymers that may be used to form the filaments for the yarns 42 of the fleece layer 40 and the filaments 32 of the tie layer 30 include polyolefins (e.g., polyethylene, polypropylene, etc.), polyesters (e.g., polyethylene terephthalate or PET), and polyamides (e.g., nylon). Synthetic filaments or synthetic yarns used to form each of the fleece side and intermediate or tie layer can be the same or different. In an example embodiment, each of the filaments forming the yarns 42 for the fleece side 40 and the filaments 32 of the tie layer 30 comprise or consist of polyester.

It is further noted that the types of yarns or filaments used to form the face layer, the fleece layer and intermediate or tie layer can be modified based upon a particular application, a desired aesthetic feel and/or functionality for the fleece textile material.

As previously noted, the knit textile 10 is formed such that the non-synthetic and/or biodegradable yarns 22 of the face layer 20 and the synthetic yarns 42 of the fleece layer 40 form loops extending from (or laying down along) the exposed surfaces of these two layers. The loops extending from each layer 20, 40 are intact, i.e., no loop extending from the exposed surface of either layer has been cut or sheared during the process of forming the fleece textile. In addition, the loops of yarns 42 extending from the exposed side or surface of the fleece layer 40 are much greater in length in comparison to the loops of yarns 22 extending from the exposed side or surface of the face layer 20, which results in the fleece layer 40 having a greater thickness in relation to the face layer 20. The length of a loop at the face layer and the fleece layer is defined as the distance from the base of the loop at the exposed side or surface of the face layer or fleece layer to the arcuate terminus or free end of the loop that extends from such surface. The lengths of the loops of the fleece layer 40 can be at least 2 times greater, or at least 3 times greater than the lengths of the loops of the face layer 20. Thus, the length ratio of the loops at the fleece layer compared to face layer are greater than 1:1 and can from at least 2:1 to 3:1 or greater. In example embodiments, the loops of non-synthetic and/or biodegradable yarns at the face layer can range from about 0.40-0.50 mm (e.g., about 0.47 mm), while the lengths of the loops of the synthetic yarns at the fleece side can range from about 1.40-1.50 mm (e.g., about 1.46 mm). As previously noted, the synthetic yarn loops at the fleece layer are not cut or sheared but instead remain intact in the final fleece textile material and in the fabric product that incorporates the fleece textile material.

The fleece textile formed is subjected to a process that mechanically manipulates the surface of the textile to generate a plush texture for added warmth, softness, and insulation. For example, a napping machine including worker rollers that strike the fabric in selected directions, thereby lifting and organizing fibers to provide the desired finish. In an embodiment, the one or more worker rollers are surface with metal or plastic (e.g., nylon) tines or bristles that contact the textile surface. The system guides the fabric over the rollers, causing the tines/bristles to gently pull at the fibers on the surface, raising the fibers to texture the fabric surface. By way of specific example, in an embodiment, the fabric is subjected to a brushing process in which the textile is processed by a plurality (e.g., at least five) rollers that sufficiently texturize and entangle loops and/or fibrils of the loops and fluff the exposed side or surface of the fleece layer of the textile. In order to sufficiently entangle and fluff the textile or fabric product to a greater extent (due at least in part to the size of the loops of the fleece layer), the processing of the textile product differs from conventional processing of fleece fabrics. In the brushing process, a plurality of consecutively arranged worker rollers or controlled adjustable roller systems (CARS) are utilized to process/brush the textile product. Each roller may rotate at a different speed and/or apply a different amount of pressure or force to the fabric surface. The number of pressure rollers or CARS is at least two, preferably at least four, more preferably at least five, or at least six, or even eight or more pressure rollers. In an embodiment, increasing force/pressure is applied by the rollers. Referring to the pressure roller system 60 of FIG. 2, the textile 10 is wrapped at least partially around each pressure roller as the textile product 10 is guided through the pressure roller system 60, e.g., utilizing 8 pressure rollers marked as rollers 1-8. The pressure applied by each roller increases as the textile product 10 is subjected to force/pressure exerted by each consecutive or sequential pressure roller. Thus, the pressure applied to the textile product is the lowest at roller 1 and the greatest at roller 8, with increasing pressure applied by each successive roller (i.e., pressure increases from roller 1→roller 2→roller 3→roller 4→roller 5→roller 6→roller 7→roller 8). This brushing process applied the textile product provides a progressive or gradual increase in pressure to the backside/fleece side of the textile product to achieve a suitable entangling/frizzing/fluffing up of the loops which are not cut or sheared. By progressively increasing the pressure in this manner, the loops can remain uncut or unsheared and not be damaged, particularly given the sizes/lengths of the loops at the exposed side or surface of the fleece layer. In fact, after the textile material has been subjected to the brushing process, a substantial portion of the yarn loops at the exposed side or surface of the fleece side remain intact (i.e., unbroken or unsheared), e.g., greater than 50% of the loops, or at least 75% of the loops, or at least 90% of the loops, or at least 95% of the loops, or at least 98% of the loops remain intact.

A final processing step for the textile product is being processed in an anti-pilling machine (e.g., tumble drying of the textile product to prevent pilling).

The fleece textile material formed has the look and feel, and further the same or similar physical properties as conventional and/or other commercially available forms of fleece textiles. However, since the fleece textile material described herein maintains the loops of yarns at the fleece side (i.e., no need to cut or shear the loops), there is less fiber material or micro sized plastics by the material to the environment during the life cycle of the material when implemented for use in fabric products.

An example method for forming the fleece textile material is now described with reference to FIGS. 2 and 3.

Figure 3:
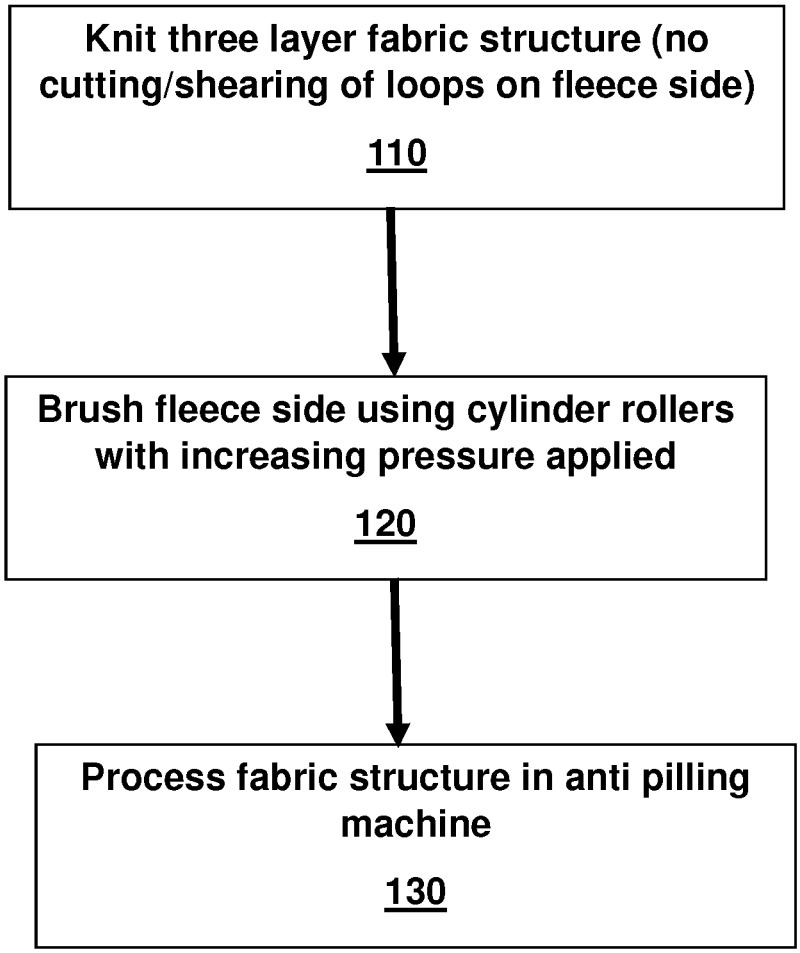
FIG. 3 is a flowchart describing an example process of forming the fleece textile of FIG. 1A.

Referring to the flowchart of FIG. 3, at 110, three types of yarns or filaments are provided and knit together in a knitting machine. In the example embodiments, the face layer 20 is formed with continuous filament yarns 22 comprising or consisting of a non-synthetic and/or biodegradable material (e.g., cotton), the intermediate or tie layer 30 is formed with synthetic tie filaments 32 (e.g., polyester filaments), and the fleece layer 40 is formed of continuous filament yarns 42 comprising or consisting of synthetic polymer material (e.g., polyester). In the knitting process, the face layer, intermediate layer and fleece layer are formed with the respective yarns or filaments forming each of the layers and with loops being formed at the exposed sides or surfaces of each of the face and fleece layers. During the forming process, the intermediate or tie layer is knit with the other two layers in a tightly secured manner so as to prevent loops at the exposed side or surface of the face layer from extending further than the loops at the exposed side or surface of the fleece layer. The knitting of the 3 layer fabric further results in maintained (i.e., non-cut or non-sheared) loops extending from each of the exposed sides or surfaces of the face layer and the fleece layer, where the loops of yarns at the fleece layer are greater in lengths than the loops of the yarns at the face layer (e.g., by a ratio of at least 2:1, or even 3:1 or greater).

At 120, the formed fabric/three layer knit structure is subjected to a brushing process in which the formed fabric is processed by a brushing system. The brushing system includes a configuration such as depicted in FIG. 2, in which a plurality of pressure rollers (e.g., at least five consecutively aligned pressure rollers) apply gradually and consecutively/sequentially increasing pressure to the fabric as the fabric engages each roller from the first roller to the last roller in the brushing system.

This process of applying increasing pressure to the fabric through a sufficient number of rollers (e.g., at least five pressure rollers) results in a sufficient entangling and frizzing of loops at the surface of each layer, particularly at the fleece layer, while preventing or minimizing cutting or shearing of loops during the brushing process. The brushing process effectively bends, twists and/or entangles yarn loops while a significant number of the loops remain continuous or intact (i.e., remain uncut or unbroken) after the brushing process. A majority (e.g., greater than 50%, or at least 75%, more preferably at least 90%) of the loops of the fleece layer and the face layer remain intact after the brushing process.

Figure 4:
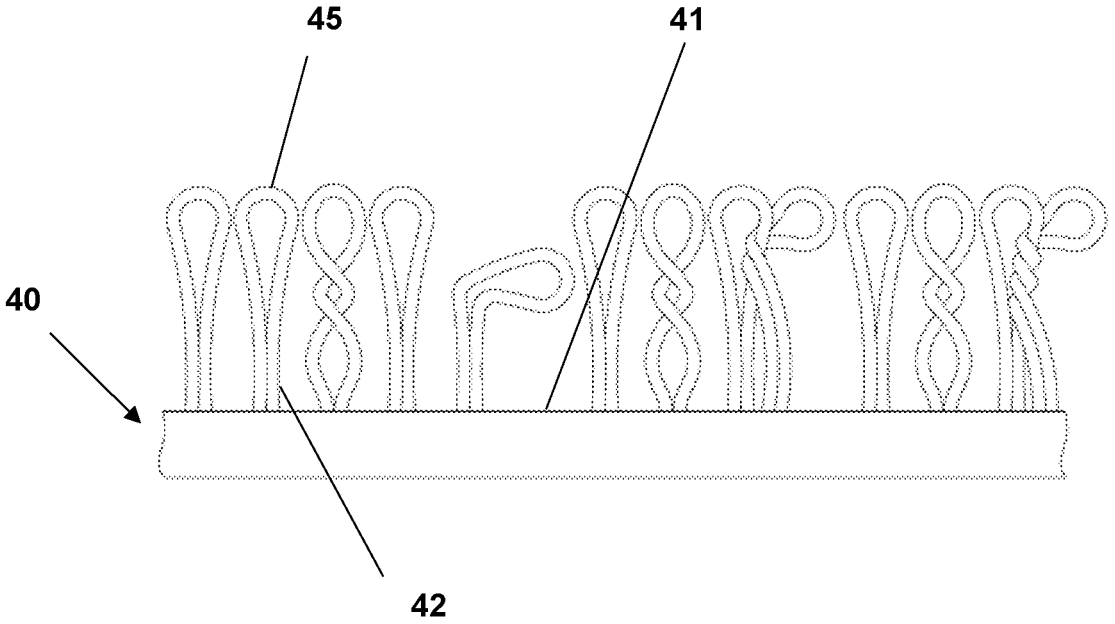
FIG. 4 is a schematic depiction showing a cross-sectional view of an enlarged portion of the fleece layer including its exposed surface and loops extending from the exposed surface for the textile of FIG. 1A, where the loops are bent, twisted and entangle with each other at the exposed surface.
Figure 5:
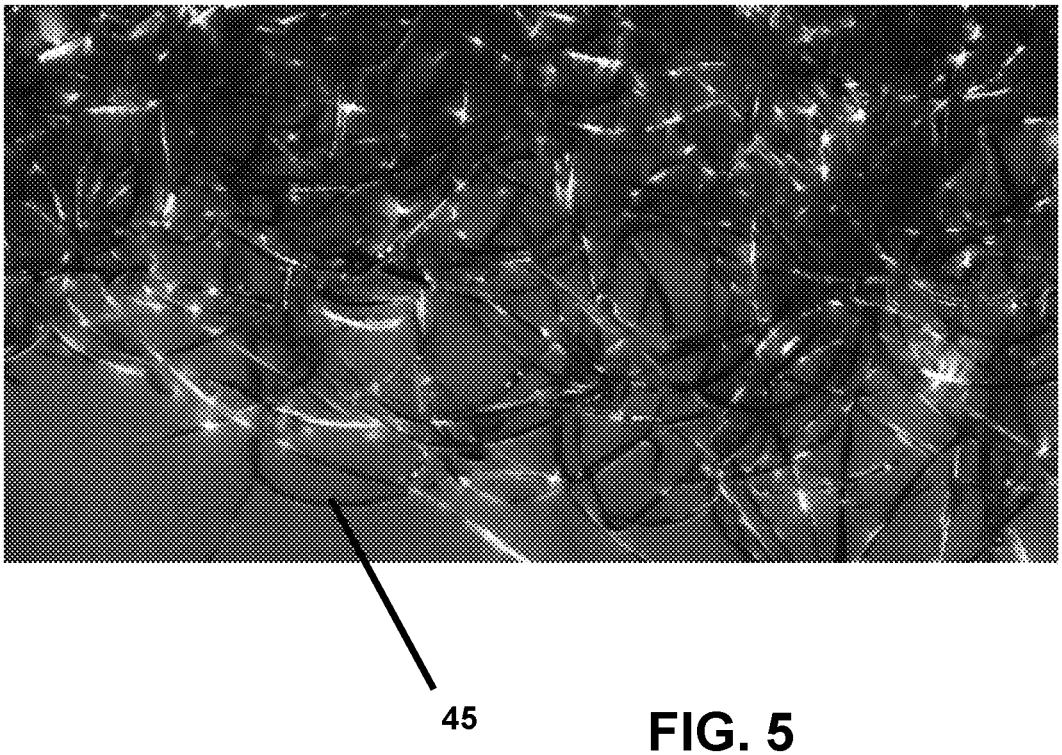
FIG. 5 is a photographic image showing a magnified view of portion of the fleece layer with loops extending from an exposed surface for the textile of FIG. 1A, where the loops are bent, twisted and entangle with each other at the exposed surface.

In particular, the brushing process (with increased pressure applied between consecutive rollers) results in bending of the loops, twisting of loops and/or entangling of neighboring loops together at the exposed surface of the fleece layer while remaining intact. Referring to the example embodiment of FIG. 4, the yarn loops at the exposed side or surface 41 of the fleece layer 40 can twist, fold over and/or twist or entangle with themselves and/or with other yarn loops as a result of the brushing process. For example, a yarn loop 45 at the exposed side of the fleece layer can extend through the opening of another neighboring yarn loop 45 so as to entangle the two loops together (i.e., one loop extends through the opening of another, neighboring loop and/or twists or entangles around the neighboring loop). One or more yarn loops 45 extending outward from the exposed surface 41 of the fleece layer 40 can also bend back toward the exposed surface 41 at any suitable angle (e.g., at least 90°). Further still, one or more yarn loops 45 can twist around themselves, e.g., a single yarn loop 45 can twist around itself to form a spiral or helical shape. The bending, twisting and entangling of yarn loops individually as well as with neighboring yarn loops as a result of the brushing process is further demonstrated in the enlarged or magnified view of FIG. 5, which shows a portion of the fleece layer 40 with yarn loops 45 bent, twisted upon themselves and/or entangled or intertwined with other yarn loops 45. Thus, the textile structure formed and the brushing process applied to the textile structure facilitates the formation of a napped surface (at least at the exposed surface of the fleece layer) comprising a mat of entangled or intertangled and continuous loops.

The brushing process can also result in frizzing of the loops, in which very small, micro-filament portions or fibrils can partially separate from yarn portions forming the loops and extend outward and away from the loops to which they remain connected so as to entangle with fibrils of adjacent or neighboring loops (i.e., loops in close proximity with each other) along an exposed side or surface of the face layer and/or fleece layer. This can further enhance the look, texture and feel of the fleece layer.

A fibril of a filament or yarn is a very fine, hair-like or much smaller diameter (or transverse cross-section) filament that frays or splits (e.g., partially splits) or frays from the filament or yarn due to the mechanical stress or abrasion applied to the loops during the brushing process. These fibrils remain connected to but also extend outward and away from the loops from which they have frayed or split, where the brushing process further results in fibrils from two or more loops wrapping around or entangling with each other. At least some loops (e.g., one loop, a plurality of loops or every loop) can include one or more fibrils, where each fibril extends from its corresponding loop and wraps around or entangles with at least one other fibril extending from an adjacent or neighboring loops. In some embodiments, one or more fibrils from a loop can entangle with one or more other fibrils from another loop. This can occur primarily or to a much greater extent at exposed side or surface of the fleece layer, since the loop length of the fleece layer are much greater than the loop lengths of the face layer.

At 130, the fabric is processed in an anti-pilling machine (e.g., a tumble dryer at a suitable process time, process temperature and process rotational speed). This can also further enhance the entangling of loops and/or fibrils extending from loops at the fleece layer exposed surface, which in turn enhances the frizzing and fleece texture and feel of the textile product.

The resultant fleece textile material can be incorporated in any suitable manner as part of a fabric product, such as an article of apparel (e.g., shirts, pants, shorts, etc.), towels, bedding, etc.

The fleece textile material as described herein exhibits a reduced amount of fiber shedding in comparison to conventional fleece fabrics. To demonstrate the low shed properties of a fleece textile material formed in accordance with the embodiments described herein, a fiber shedding test was conducted for the fleece textile material using the DIN SPEC 19292:2024-12 testing standard. This testing standard also corresponds with the disclosure provided in U.S. patent application Ser. No. 18/340,405, the entire contents of which are incorporated herein by reference. Briefly, this testing standard accurately determines an amount of fiber shedding associated with a textile material by subjecting a sample of the textile material to specific washing steps to simulate washing of a fabric (e.g., in a conventional washing machine), and fibers separated from the sample and entrained in the water used to wash the sample are collected and analyzed for content. The analysis of the collected fibers includes comparison of the collected fibers with a standardized grading scale based upon the DIN SPEC 19292:2024-12 testing standard. Such analysis utilizing this grading scale provides an indicator of the level or amount of fibers shed by the textile material from which the sample was taken. The standardized grading scale of the DIN SPEC 19292:2024-12 testing standard provides a number rating which correlates with a level of fiber shading as set forth in Table 1 herein:

TABLE 1

DIN SPEC 19292:2024-12 Classification scheme

| Grade | Description |
|---|---|
| 5 | Very slight amount of fiber |
| 4 | Slight amount of fiber |
| 3 | Moderate amount of fiber |
| 2 | Dense amount of fiber |
| 1 | Very dense amount of fiber |

Thus, a degree or amount of fiber shedding increases with lower rating number (with a rating of 1 being the worst/very dense fiber shedding), while a higher rating number indicates less or very low fiber shedding (with a rating of 5 being very slight amount or no fiber shedding).

Figure 2:
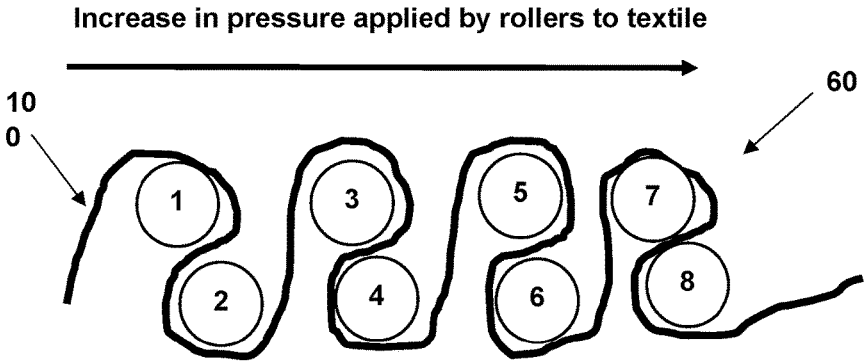
FIG. 2 is a schematic example embodiment of a series of pressure rollers used to process the textile after formation to achieve a look and feel of fleece.

The fleece textile material that was tested corresponded with the embodiment depicted herein and shown in FIG. 1A, where the textile material was further processed utilizing the method as described herein and as depicted in the flowchart of FIG. 3, including use of the progressively increasing pressure roller system such as the type depicted in FIG. 2. The textile material was knit as a three layer material including a face layer formed of continuous filament yarns of cotton, an intermediate layer formed of polyester continuous filaments, and a fleece layer formed of continuous filament yarns formed of polyester. The loops on the exposed side or surface for each of the face layer and fleece layer were substantially intact (not cut or sheared), even after the roller process, where the loops of the fleece layer were greater (e.g., 2-3 times greater) than the loops of the face layer.

Samples were taken from the textile material and tested for fiber shedding initially (prior to any wash) and also after a 3× wash process (i.e., 3 standard washing machine cycles for the textile material). The fiber shedding test was conducted for samples at the surface of the face layer and also the surface of the fleece layer for each sample test. The DIN SPEC 19292:2024-12 testing standard fiber shedding grade results for the samples are provided in Table 2 herein:

TABLE 2

Fiber shedding grade for tested samples

| | Fleece side fiber shedding grade (average of all samples) | Face side fiber shedding grade (average of all samples) |
|---|---|---|
| Initial test (pre-wash) | 3.5 | 4 |
| Test after 3× wash | 4 | 3.5 |

Comparatively, conventional fleece textiles formed with the face layer formed of yarns of a spun polyester/cotton blend, an intermediate layer including polyester filaments, and a fleece layer formed of CVC yarns were also tested in the same manner as the textile material described herein. In particular, two types of fleece fabric materials were also tested. The low shed fleece textile material tested performed significantly better with regard to fiber testing in comparison to the conventional fleece fabrics (including CVC fleece layers) also tested, scoring higher in the fiber shedding grade based upon the DIN SPEC 19292:2024-12 testing standard.

Thus, the fleece textile material described herein provides all the benefits of fleece (e.g., soft, insulating, lightweight, etc.) while minimizing shedding of fibers and/or micro plastics to the environment.

While the invention has been described in detail and with reference to specific embodiments thereof, it will be apparent to one skilled in the art that various changes and modifications can be made therein without departing from the spirit and scope thereof.

It is thus intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

What is claimed:

1. An article of apparel comprising:

An outer, face layer constructed of first yarns, the face layer including an exposed, first surface including first loops of the first yarns extending from the first surface, and the first yarns comprising one or more non-synthetic materials and/or biodegradable materials;

An inner, user-facing fleece layer constructed of second yarns, the fleece layer including an exposed, second surface that opposes the first surface and includes second loops of the second yarns extending from the second surface, and the second yarns comprising one or more synthetic materials; and an intermediate layer constructed of filaments, the intermediate layer being disposed between the face layer and the fleece layer with the filaments of the intermediate layer coupling with each of the first yarns and the second yarns, and the filaments of the intermediate layer comprising one or more synthetic materials;

wherein the second loops have greater lengths than the first loops.

2. The article of apparel of claim 1, wherein:

the first yarns consist of one or more non-synthetic materials and/or highly biodegradable materials;

the second yarns consist of one or more synthetic materials; and the filaments of the intermediate layer consist of one or more synthetic materials.

3. The article of apparel of claim 2, wherein the first yarns comprise cotton.

4. The article of apparel of claim 2, wherein each of the second yarns and/or the filaments of the intermediate layer comprise polyester.

5. The article of apparel of claim 1, wherein at least 75% of the second loops of the fleece layer are continuous and intact.

6. The article of apparel of claim 1, wherein a length of each second loop is at least two times a length of each first loop.

7. The article of apparel of claim 1, wherein a length of each second loop is at least three times a length of each first loop.

8. The article of apparel of claim 1, wherein the fleece textile comprises a knit material in which the first, second and intermediate layers are also formed via knitting.

9. The article of apparel of claim 1, wherein at least one second loop bends toward the second surface, at least another second loop twists to form a helical shape, and at least one further second loop entangles with a neighboring second loop.

10. The article of apparel of claim 1, wherein:

at least some of the first loops and the second loops include fibrils extending from the first loops and the second loops;

at least one fibril extending from at least one first loop extends toward and entangles with at least one other fibril extending from a neighboring first loop that is in proximity with the at least one first loop; and at least one fibril extending from at least one second loop extends toward and entangles with at least one other fibril extending from a neighboring second loop that is in proximity with the at least one second loop.

11. The article of apparel of claim 1, wherein the article of apparel rates at least a 3.0 in accordance with DIN SPEC 19292:2024-12.

12. A textile comprising:

a face layer constructed of first yarns, the face layer including an exposed, first surface including first loops of the first yarns extending from the first surface, and the first yarns comprising a non-synthetic and/or biodegradable material;

a backside layer constructed of second yarns, the backside layer including an exposed, second surface that opposes the first surface and includes second loops of the second yarns extending from the second surface, and the second yarns comprising polyester; and an intermediate layer constructed of filaments, the intermediate layer being disposed between the face layer and the backside layer with the filaments of the intermediate layer coupling with each of the first yarns and the second yarns, and the filaments of the intermediate layer comprising polyester;

wherein the second loops have greater lengths than the first loops.

13. The textile of claim 12, wherein the first yarns consist of a non-synthetic and/or biodegradable material.

14. The textile of claim 13, wherein the first yarns comprise cotton.

15. The textile of claim 14, wherein the first yarns and the filaments of the intermediate layer consist of polyester.

16. A method of forming a textile, the method comprising:

knitting a face layer with first yarns, the face layer defining an exposed, first surface with first loops of the first yarns extending from the first surface, and the first yarns comprising one or more non-synthetic materials and/or biodegradable materials;

knitting a backside layer with second yarns, the backside layer defining an exposed, second surface with second loops of the second yarns extending from the second surface, and the second yarns comprising one or more synthetic materials; and knitting an intermediate layer with filaments, the intermediate layer being disposed between the face layer and the backside layer with the filaments of the intermediate layer coupling with each of the first yarns and the second yarns so as to form a three layer knit structure, and the filaments of the intermediate layer comprising one or more synthetic materials;

wherein the knitting the face layer and backside layer results in the second loops having greater lengths than the first loops.

17. The method of claim 16, further comprising:

processing the three layer knit structure with a brushing machine comprising a plurality of consecutively arranged pressure rollers, wherein the three layer knit structure is processed by each pressure roller with increasing pressure applied to the three layer knit structure as the three layer knit structure is sequentially engaged with each successive pressure roller.

18. The method of claim 16, wherein the three layer knit structure is consecutively processed by at least five pressure rollers of a brushing machine.

19. The method of claim 18, further comprising:

processing the three layer knit structure in an anti-pilling machine after the processing with the brushing machine.

20. The method of claim 16, wherein the face layer is formed with first yarns that consist of one or more non-synthetic materials.

* * * * *